US008202041B2

(12) United States Patent
Wojtyczka et al.

(10) Patent No.: US 8,202,041 B2
(45) Date of Patent: Jun. 19, 2012

(54) FAN CASE FOR TURBOFAN ENGINE

(75) Inventors: Czeslaw Wojtyczka, Brampton (CA); Andrew Marshall, Grand Valley (CA)

(73) Assignee: Pratt & Whitney Canada Corp, Longueuil (CA)

( * ) Notice: Subject to any disclaimer, the term of this patent is extended or adjusted under 35 U.S.C. 154(b) by 704 days.

(21) Appl. No.: 12/262,583

(22) Filed: Oct. 31, 2008

(65) Prior Publication Data

US 2010/0111675 A1 May 6, 2010

(51) Int. Cl.
*F01D 29/66* (2006.01)

(52) U.S. Cl. ..... 415/119

(58) Field of Classification Search ..... 415/9, 119, 415/200, 173.1, 174.4; 60/226.1, 909; 29/889.7
See application file for complete search history.

(56) References Cited

U.S. PATENT DOCUMENTS

| | | | | |
|---|---|---|---|---|
| 3,874,855 | A | 4/1975 | Legrand | |
| 4,149,824 | A | 4/1979 | Adamson | |
| 4,507,047 | A | 3/1985 | Coons | |
| 4,534,698 | A | 8/1985 | Tomich | |
| 4,547,122 | A | 10/1985 | Leech | |
| 4,699,567 | A | 10/1987 | Stewart | |
| 4,734,007 | A | 3/1988 | Perry | |
| 5,336,044 | A | 8/1994 | Forrester | |
| 5,344,280 | A * | 9/1994 | Langenbrunner et al. | 415/9 |
| 5,408,826 | A | 4/1995 | Stewart et al. | |
| 5,409,349 | A | 4/1995 | Kulak et al. | |
| 5,413,456 | A | 5/1995 | Kulak et al. | |
| 5,431,532 | A | 7/1995 | Humke et al. | |
| 5,437,538 | A * | 8/1995 | Mitchell | 415/9 |
| 5,447,411 | A * | 9/1995 | Curley et al. | 415/9 |
| 5,482,429 | A * | 1/1996 | Penda | 415/9 |
| 5,485,723 | A | 1/1996 | McCoy et al. | |
| 5,486,086 | A | 1/1996 | Bellia et al. | |
| 5,513,949 | A | 5/1996 | Armstrong | |
| 5,516,257 | A | 5/1996 | Kasprow et al. | |
| 5,516,258 | A | 5/1996 | Newton | |
| 5,885,056 | A | 3/1999 | Goodwin | |
| 6,053,696 | A | 4/2000 | Roberts | |
| 6,394,746 | B1 | 5/2002 | Sathianathan et al. | |
| 6,497,550 | B2 | 12/2002 | Booth | |
| 6,543,991 | B2 | 4/2003 | Sathianathan et al. | |
| 6,575,694 | B1 | 6/2003 | Thompson et al. | |
| 6,619,913 | B2 * | 9/2003 | Czachor et al. | 415/119 |
| 6,638,008 | B2 | 10/2003 | Sathianathan et al. | |
| 6,652,222 | B1 | 11/2003 | Wojtyczka et al. | |
| 6,739,830 | B2 | 5/2004 | Sathianathan et al. | |
| 6,913,436 | B2 | 7/2005 | McMillan et al. | |
| 7,076,942 | B2 | 7/2006 | Schreiber | |
| 7,192,243 | B2 | 3/2007 | Lawson et al. | |
| 7,255,528 | B2 | 8/2007 | Stretton | |
| 7,524,161 | B2 | 4/2009 | Lawson et al. | |
| 2008/0145215 | A1 * | 6/2008 | Finn et al. | 415/200 |
| 2009/0087309 | A1 | 4/2009 | Schreiber | |
| 2009/0155044 | A1 | 6/2009 | Xie et al. | |

* cited by examiner

*Primary Examiner* — Alexander Gilman
(74) *Attorney, Agent, or Firm* — Norton Rose Canada LLP

(57) ABSTRACT

A gas turbine engine rotor containment structure comprises an inner structurally supporting case having an inner surface positioned adjacent to a gas turbine engine rotor component to be contained. A layer of acoustic material is wrapped around and bounded to a radially outer surface of the inner case. A thin walled outer ring is bounded to a radially outer surface the layer of acoustic material. A layer of fibrous containment material surrounds a radially outer surface of the outer ring.

18 Claims, 2 Drawing Sheets

FAN CASE FOR TURBOFAN ENGINE

TECHNICAL FIELD

The application relates generally to fan case for turbofan gas turbine engines and, more particularly, to a fan blade containment structure therefor.

BACKGROUND OF THE ART

Turbofan engines typically have a fan with a hub and a plurality of fan blades disposed for rotation about a central axis. The casing surrounding the fan blades must be able to contain a broken fan blade propelled outwardly from the rotating hub at high speed.

Thus, the fan case includes a containment structure, which may have one of many various known designs, including designs employing composites, which can include a containment fabric layer, such as Kevlar®. The containment fabric is typically wrapped in multiple layers around a relatively thin, often penetrable supporting case, positioned between the blades and the fabric layer. Thus, a released blade will penetrate the support case and strike the fabric. The fabric deflects radially capturing and containing the released blade but largely remains intact.

One problem with such arrangement is that a fan blade tip rub may ruin the containment fabric if the blade tip contacts the containment fabric, thereby prejudicing the strength of the fabric. For this reason, a larger tip clearance is usually provided between the blade tips and the fan case to ensure tip rubs do not occur. This however results in a less efficient fan, larger fan case envelope and thus in extra engine weight.

Accordingly, there is a need to provide an improved softwall fan case containment design.

SUMMARY

In one aspect, there is provided a turbofan engine comprising: a fan case surrounding a set of fan blades mounted for rotation about a central axis of the engine, the fan case having: a structurally supporting metal or composite inner shell having an axially extending wall with a radially inner side closely surrounding tips of the fan blades and defining a continuous flow boundary surface from a first location fore of the fan blades to a second location aft of the fan blades, an axially extending nesting chamber defined on a radially outer side of the axially extending wall of the structurally supporting metal or composite inner shell, said nesting chamber extending from a third location fore of the fan blades to a fourth location aft of the fan blades, an acoustic liner filling said nesting chamber, the acoustic liner axially spanning the fan blades; a stiffening ring secured to a radially outer surface of the acoustic liner and the structurally supporting metal or composite shell, the stiffening ring sealing the acoustic liner in the nesting chamber; and an outer blade containment fabric layer wrapped around the stiffening ring.

In a second aspect, there is provided a turbofan engine comprising a fan case surrounding a circumferential array of fan blades mounted for rotation about an axis of the turbofan engine, the fan case having a structurally supporting inner shell having an axially extending annular wall with a radially inner side defining a flow boundary surface adjacent to tips of the fan blades for guiding an incoming flow of air, a thin walled stiffening ring surrounding the structurally supporting inner shell, a layer of honeycomb material sandwiched between the structurally supporting inner shell and the thin walled stiffening ring, the structurally supporting inner shell being made of a stronger material than the layer of honeycomb material, the layer of honeycomb material extending axially continuously from a location fore of the fan blades to a location aft of the fan blades, wherein the structurally supporting inner shell, the layer of honeycomb material and the thin walled stiffening ring are all connected together so as to form a structurally integrated assembly in which the honeycomb material contributes to increase a stiffness of the assembly as well as performing a structural load bearing function; and a layer of blade containment material wrapped around the stiffening ring to retain blades or blade fragments in the event of blade off event.

In a third aspect, there is provided a gas turbine engine containment structure comprising an inner structural case, the structural case having a radially inner cylindrical surface positioned around and adjacent to a gas turbine engine rotor component to be contained, a layer of acoustic material wrapped around and bounded to a radially outer cylindrical surface of the structural inner case, a thin walled stiffener ring bounded to a radially outer surface the layer of acoustic material, and a layer of high-strength fibrous containment material surrounding a radially outer surface of the thin walled stiffener ring.

DESCRIPTION OF THE DRAWINGS

Reference is now made to the accompanying figures, in which.

DETAILED DESCRIPTION OF THE PREFERRED EMBODIMENTS

Figure 1:
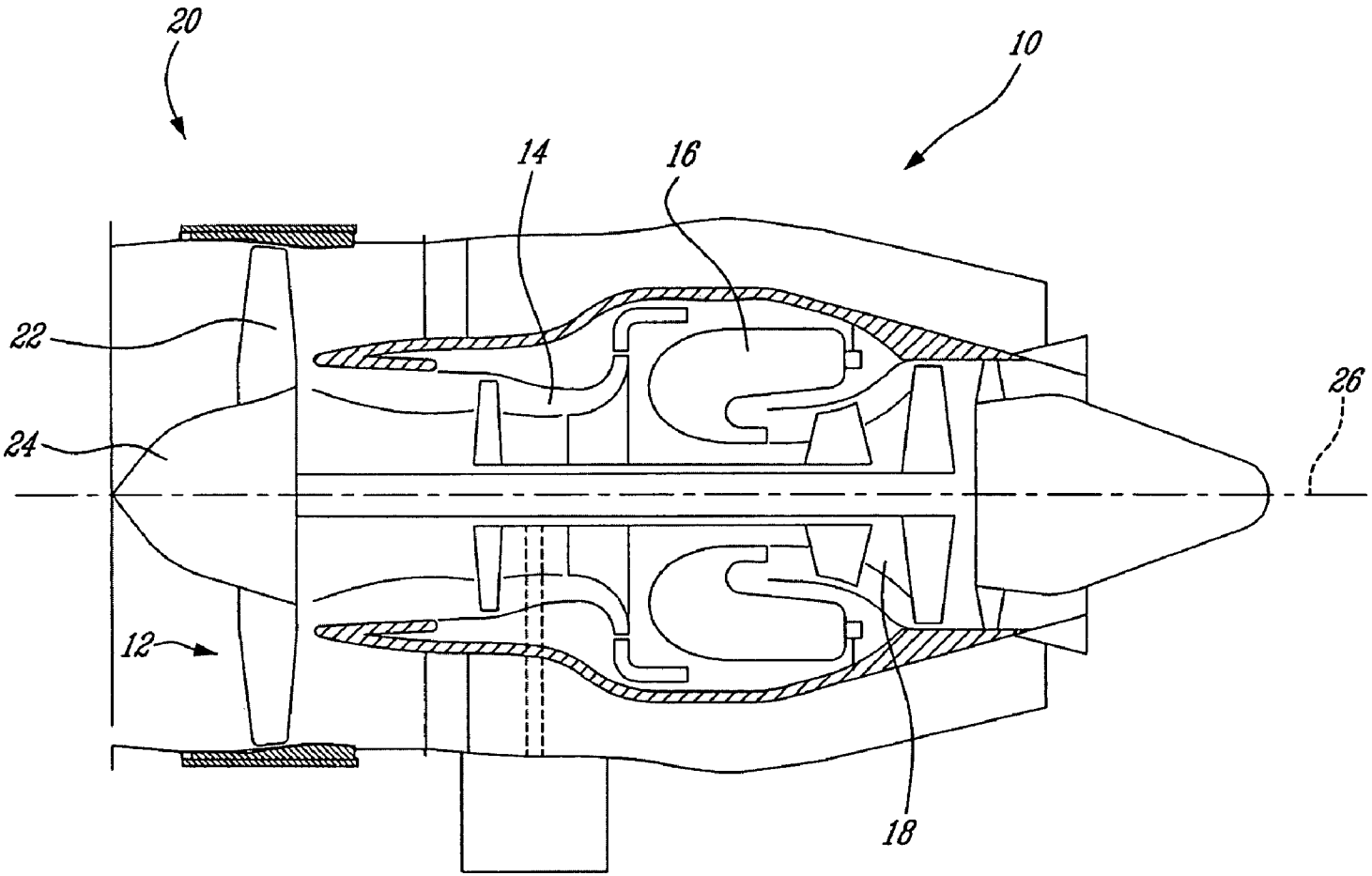
FIG. 1 is a schematic cross-sectional view of a turbofan gas turbine engine including a fan case having a blade containment structure.

FIG. 1 illustrates a turbofan gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. The fan 12 includes a fan case 20 surrounding a circumferential array of fan blades 22 extending radially outwardly from a rotor 24 mounted for rotation about the central axis 26 of the engine 10.

Figure 2:
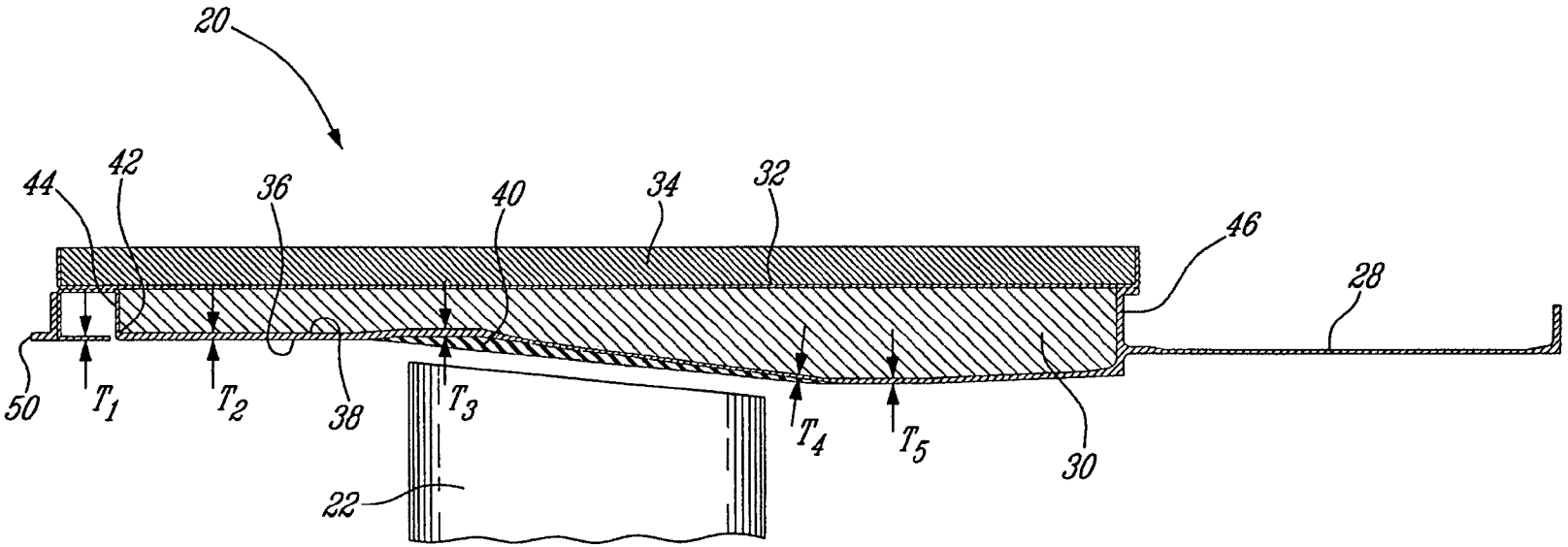
FIG. 2 is a detailed schematic cross-sectional view of a portion of the fan case shown in FIG. 1.

As shown in FIG. 2, the fan case 20 has an annular softwall sandwiched structure designed for containing blade fragments or blades in the event of a blade-out incident during engine operation. As will be seen herein after, the present design allows minimizing the outside diameter and the weight of the fan case 20 while still providing for the required blade containment capability.

The fan case 20 generally comprises a structurally supporting thin walled strong inner shell 28, a lightweight honeycomb material 30 wrapped around the inner shell 28, a thin walled stiffening ring 32 enveloping the lightweight honeycomb material 30, and an outer containment fabric layer 34 wrapped around the stiffening ring 32.

In the illustrated example, the inner shell 28 is provided in the form of a one piece continuous annular metallic part. More particularly, the inner shell 28 could be made of steel, aluminium, titanium or other lightweight high-strength metal alloys. Alternatively, the inner shell 28 could be made of composite materials or any other substantially rigid materials having sufficient structural capabilities.

The inner shell 28 has an axially extending wall having a radially inner side 36 and an opposed radially outer side 38. The radially inner side 36 constitutes the innermost surface of the fan case 20 and closely surrounds the tips of the blades 22 while extending axially fore and aft of the blades 22. The radially inner side 36 of the structurally supporting annular shell 28 forms an axially continuous (non-interrupted) flow boundary surface for the incoming air. An abradable tip clearance control layer 40 is provided on the radially inner side 36 in axial alignment with the tips of the blades 22 in order to enable close tolerances to be maintained between the blade tips and the radially inner side of the inner shell 28. The reduction of the required blade tip to the inner case "30" clearance due to the increased ability of the high strength material to be rub tolerant in the event of a bird strike contributes to minimize the required outside diameter of the fan case 20. The abradable tip clearance control layer 40 is made of an abradable material which helps protecting the fan blades 22 and the containment material. The abradable layer 40 can be made from any suitable abradable coating material such as 3M's Scotch Weld™ or a similar and/or functionally equivalent epoxy based abradable compound.

The inner shell 28 can be optimized to reduce weight both through reduce fan case outside diameter and optimized skin thickness. As can be appreciated from FIG. 2, the axially extending wall of the inner shell 28 may have variable thicknesses T1 . . . T5 along the length thereof. The variable material thicknesses are distributed at strategic locations along the inner shell 28 to optimize the cost, weight and structural integrity of the shell. The thickness of the axially extending inner shell wall may be variable to minimize damage area due to release blade penetration and allowing sufficient support for the outer containment layer 34. This design reduces the risk of the blades puncturing/cutting the containment fabric 34 as the detached blades or blades fragments will deform as a result of their initial impact with the locally reinforced inner shell 28. A low cost manufacturing process know as "flow forming" can be used to provide such localized wall thickness increase at strategic locations along the inner shell 28. Other suitable manufacturing processes are considered as well where localized ribs are preferred and "flow forming" is not suited. As can be seen in FIG. 2, the thickness of the axially extending wall of the inner shell 28 is generally greater in front and in the vicinity of the leading edges of the fan blades 22 than in locations downstream to or adjacent to the trailing edges of the fan blades 22 (T2 and T3 are greater than the T4 and T5). The foremost end of the inner shell 28 is less likely to be impacted upon by a blade fragment and is thus made thinner (see T1 in FIG. 2.

An axially extending nesting chamber is formed on the radially outer circumference 38 of the inner shell 28 for receiving the lightweight or collapsible honeycomb material 30. The front and rear ends of the chamber 38 are bounded by front and rear circumferential flanges 44 and 46 extending radially outwardly from the outer side 38 of the inner shell 28 at locations fore and aft of the fan blades 22. The lightweight honeycomb material 30 completely fills the chamber 42 and is sealed therein by the stiffening ring 32. The lightweight honeycomb material 30 extends continuously from the front end of the chamber 42 to the rear end thereof, thereby fully axially spanning the tips of the blades 22. The material 30 is bonded or otherwise suitably secured to the radially outer side 38 of the inner shell 28 and the radially inner side of the stiffening ring 32. The stiffening ring 32 is also bonded or otherwise secured to the front and rear flanges 44 and 46 of the inner shell 28. The inner shell 28, the honeycomb material 30 and the stiffening ring 32 are, thus, structurally integrated to one another. In other words, the honeycomb material 30 not only provides for small blade fragments retention and kinetic energy absorption, but also plays a structural role in contributing to stiffen/reinforce the fan case assembly and can utilize varying densities at specific locations as structurally or acoustically required. The honeycomb material 30 provides a load path to transfer structural loads from the inner shell 28 to stiffening ring 32 and vice versa. Such a structural integration of the lightweight material 30 allows using a thinner inner shell 28 and a thinner stiffening ring 32, thereby contributing to minimize the overall weight of the blade containment fan case.

The lightweight honeycomb material 30 can be provided in the form of an acoustic material. In this case, the honeycomb material also provides for acoustic damping. For instance, a honeycomb foam composite (HFC) material could be used. The honeycomb material can be metallic or non-metallic. For instance, the following two products manufactured by Hexcel Corporation could be used: aluminium honeycomb CR-PAA/CRIII or non-metallic honeycomb HRH-10. The honeycomb material may be composed of multiple pieces in order to provide added acoustical treatment or improved localized stiffness. For instance, the radial thickness of the lightweight material 30 can range from about ¼" to 2". It is also understood that the thickness will vary depending of the size of the engine.

The stiffening ring 32 can be made from the same material as the inner shell 28. In the illustrated example, sheet metal is used. However, a composite fabric wrap could be used as well to form the stiffening ring 32. The stiffening ring 28 is bonded to the outer surface of the honeycomb material 30 and the inner shell 28 to seal the honeycomb material in the chamber 42, stiffen the inner shell 28 and provide a surface for the containment material 34 to be wrapped around. The thickness of the stiffening ring 32 can range from about 0.2 to about 2". For larger engines, a minimum of 0.5 inch is recommended.

The containment material may be constructed of aromatic polyamide fabric such as Kevlar®, which has a relatively light weight and high strength. Other high-strength woven fibrous materials (e.g. ballistic type fabrics) could be used as well. Any suitable reinforcing fibres can be used to form the outer blade containment ring including, but not limited to, glass fibres, graphite fibres, carbon fibres, ceramic fibres, aromatic polyamide fibres (also known as aramid fibres), for example poly(p-phenyletherephtalamide) fibres (Kevlar® fibres), and mixtures thereof. Any suitable resin can be used in the inner fabric layer 46, for example, thermosetting polymeric resins such as vinyl ester resin, polyester resins, acrylic resins, polyurethane resins, and mixture thereof.

The outside disposition of the containment material 34 (i.e. outwardly of the inner shell 28, the acoustic liner 30 and the stiffening ring 32) also contributes to minimize the outside diameter of the fan case 20 in that no extra blade tip clearance is required in order to prevent the blades 22 from rubbing into the containment fabric after a fan blade off event. The interposition of the lightweight material 30 (e.g. the honeycomb structure) between the fan blades 22 and the containment material 34 and, more particularly, the placement of a honeycomb structure on the outer side 38 of the inner shell 28, contributes to the reduction of the required blade tip clearance.

A separately formed locknut containment ring 50 is attached to the front end of the inner shell 28 for connection with the nacelle inlet lip (not shown). The locknut containment ring 50 provides a connection interface for allowing mounting of the nacelle inlet lip to the fan case 20.

The fan containment case is fabricated, in an exemplary embodiment, by wrapping-up a layer of honeycomb material 30, a metal or composite sheeting 32 and a high strength fibrous containment material 34, consecutively, about a cylindrical thin walled metal or composite shell 28 formed by a flow forming manufacturing process to have different localised thicknesses along the length thereof. Each layer is bounded or otherwise suitably attached to the next to create a structurally integrated composite fan case.

The softwall fan case design described above is relatively light weight, compact, while providing a cost effective blade containment system and good vibration and sound damping structure over hard walled and softwall fan case designs.

The above description is meant to be exemplary only, and one skilled in the art will recognize that changes may be made to the embodiments described without departing from the scope of the invention disclosed. It is to be understood that the thickness, density and other properties of each of the layers of the fan case can vary depending on a number of design factors, including engine size and configuration for example still other modifications which fall within the scope of the present invention will be apparent to those skilled in the art, in light of a review of this disclosure, and such modifications are intended to fall within the appended claims.

What is claimed is:

1. A turbofan engine comprising:

a fan case surrounding a set of fan blades mounted for rotation about a central axis of the engine, the fan case having:

a structurally supporting metal or composite inner shell having an axially extending wall with a radially inner side closely surrounding tips of the fan blades and defining a continuous flow boundary surface from a first location fore of the fan blades to a second location aft of the fan blades, an axially extending nesting chamber defined on a radially outer side of the axially extending wall of the structurally supporting metal or composite inner shell, said nesting chamber extending from a third location fore of the fan blades to a fourth location aft of the fan blades, wherein the axially extending wall of the structurally supporting metal or composite inner shell has axially spaced-apart regions of different wall thicknesses along a length thereof, the thickness of the axially extending wall being greater at a leading edge of the fan blades than at a trailing edge thereof;

an acoustic liner filling said nesting chamber, the acoustic liner axially spanning the fan blades;

a stiffening ring secured to a radially outer surface of the acoustic liner and the structurally supporting metal or composite inner shell, the stiffening ring sealing the acoustic liner in the nesting chamber; and an outer blade containment fabric layer wrapped around the stiffening ring.

2. The turbofan engine defined in claim 1, wherein a front and a rear circumferential flange extend radially outwardly from the radially outer side of the axially extending wall of the structurally supporting metal or composite inner shell, the nesting chamber being defined between said front and rear flanges, and wherein the stiffening ring extends over said front and rear flanges and is bonded thereto to seal the acoustic liner in the nesting chamber.

3. The turbofan engine defined in claim 1, wherein the acoustic liner comprises a honeycomb structure defining a structural load path between the structurally supporting metal or composite inner shell and the stiffening ring, the acoustic liner being attached to both the structurally supporting metal or composite inner shell and the stiffening ring.

4. The turbofan engine defined in claim 1, wherein said structurally supporting metal or composite inner shell is a one-piece continuous metallic shell, and wherein said axially extending wall has a thickness which is greater in the vicinity of a leading edge of the fan blades than in the vicinity of a trailing edge of the fan blades.

5. The turbofan engine defined in claim 1, wherein said structurally supporting metal or composite inner shell, said stiffening ring and said acoustic liner have respective thicknesses T1, T2 and T3, and wherein T3 is greater than T1 and T2.

6. The turbofan engine defined in claim 1, wherein the outer blade containment fabric layer is made of a high-strength woven fibrous material containing fibres selected from a group consisting of: glass fibres, graphite fibres, carbon fibres, ceramic fibres, aromatic polyamide or aramide fibres and mixtures thereof.

7. The turbofan engine defined in claim 1, wherein the stiffening ring is made from metal sheet or from a composite sheeting material.

8. A turbofan engine comprising a fan case surrounding a circumferential array of fan blades mounted for rotation about an axis of the turbofan engine, the fan case having a structurally supporting inner shell having an axially extending annular wall with a radially inner side defining a flow boundary surface adjacent to tips of the fan blades for guiding an incoming flow of air, a thin walled stiffening ring surrounding the structurally supporting inner shell, a layer of honeycomb material sandwiched between the structurally supporting inner shell and the thin walled stiffening ring, the structurally supporting inner shell being made of a stronger material than the layer of honeycomb material, the layer of honeycomb material extending axially continuously from a location fore of the fan blades to a location aft of the fan blades, wherein the structurally supporting inner shell, the layer of honeycomb material and the thin walled stiffening ring are all connected together so as to form a structurally integrated assembly in which the honeycomb material contributes to increase a stiffness of the assembly as well as performing a structural load bearing function; and a layer of blade containment material wrapped around the stiffening ring to retain blades or blade fragments in the event of blade off event, wherein the structurally supporting inner shell has a wall thickness which is greater at the leading edge of the fan blades than at the trailing edge thereof.

9. The fan case defined in claim 8, wherein the layer of honeycomb material is bonded to a radially outer side of the axially extending annular wall of the structurally supporting inner shell and to a radially inner side of the thin walled stiffening ring.

10. The fan case defined in claim 8, wherein the layer of blade containment material comprises a high-strength fibrous fabric, and wherein the structurally supporting inner shell, the layer of honeycomb material and the stiffening ring being all three interposed between the fan blades and the high-strength fibrous fabric to protect the high strength fibrous fabric against blade rubbing.

11. The fan case defined in claim 10, wherein the high-strength fibrous fabric includes Kevlar®.

12. The fan case defined in claim 10, wherein the thickness of the axially extending wall of the structurally supporting inner shell and of the thin walled stiffening ring is less than the thickness of the layer of honeycomb material, the structurally supporting inner shell and the thin walled stiffening ring being made of metal or a composite material.

13. The fan case defined in claim 10, wherein an annular nesting chamber is defined between the structurally supporting inner shell and the thin walled-stiffening ring, the nesting chamber is closed at opposed axial ends thereof, said axial ends being respectively located fore and aft of the fan blades, and wherein the layer of honeycomb material extends axially continuously from one of the axial ends of the nesting chamber to the other one thereof.

14. A gas turbine engine containment structure comprising an inner structural case, the structural case having a radially inner cylindrical surface positioned around and adjacent to a gas turbine engine rotor component to be contained, a layer of acoustic material wrapped around and bounded to a radially outer cylindrical surface of the structural inner case, a thin walled stiffener ring bounded to a radially outer surface the layer of acoustic material, and a layer of high-strength fibrous containment material surrounding a radially outer surface of the thin walled stiffener ring, the inner structural case having a wall thickness which is greater at the leading edge of the rotor component than at the trailing edge thereof.

15. The gas turbine engine containment structure defined in claim 14, wherein inner structural case and the thin walled stiffener ring are made from a composite material or metal.

16. The gas turbine engine containment structure defined in claim 14, wherein the layer of high-strength fibrous containment material contains fibres selected from a group consisting of: glass fibres, graphite fibres, carbon fibres, ceramic fibres, aromatic polyamide or aramide fibres and mixtures thereof.

17. The gas turbine engine containment structure defined in claim 14, wherein the structural inner case has a radially outer cylindrical surface, the radially inner and radially outer cylindrical surfaces defining the wall thickness, and wherein said wall thickness varies to reach a maximum value in a region close to the gas turbine engine rotor component to be contained.

18. The gas turbine engine containment structure defined in claim 14, wherein the layer of acoustic material comprises a honeycomb foam composite material.

* * * * *